US008387180B1

(12) United States Patent
Rizzardo

(10) Patent No.: US 8,387,180 B1
(45) Date of Patent: Mar. 5, 2013

(54) BED WITH GRID DECK

(75) Inventor: Dennis Paul Rizzardo, Fond du Lac, WI (US)

(73) Assignee: GF Health Products, Inc., Atlanta, GA (US)

( * ) Notice: Subject to any disclaimer, the term of this patent is extended or adjusted under 35 U.S.C. 154(b) by 286 days.

(21) Appl. No.: 12/435,169

(22) Filed: May 4, 2009

Related U.S. Application Data

(63) Continuation-in-part of application No. 29/331,033, filed on Jan. 17, 2009, now Pat. No. Des. 616,666.

(51) Int. Cl.
*A47C 21/08* (2006.01)

(52) U.S. Cl. ..... 5/429; 5/618

(58) Field of Classification Search ..... 5/620, 263–266, 5/425, 428–430, 11, 607, 611, 613–618, 5/509.1, 662, 100, 424
See application file for complete search history.

(56) References Cited

U.S. PATENT DOCUMENTS

| | | | | |
|---|---|---|---|---|
| 836,961 | A * | 11/1906 | Carr | 5/617 |
| 3,281,873 | A * | 11/1966 | Stanley et al. | 5/618 |
| 3,823,428 | A * | 7/1974 | Whyte | 5/429 |
| 3,932,903 | A * | 1/1976 | Adams et al. | 5/100 |
| 6,276,011 | B1 * | 8/2001 | Antinori | 5/618 |
| 6,473,921 | B2 * | 11/2002 | Brooke et al. | 5/600 |
| 7,093,312 | B2 * | 8/2006 | Mossbeck | 5/613 |

* cited by examiner

*Primary Examiner* — Robert G Santos
*Assistant Examiner* — Nicholas Polito
(74) *Attorney, Agent, or Firm* — Brannen Law Office, LLC

(57) ABSTRACT

The present invention relates to a bed having a rigid deck supported over the base. Four sections can be provided, with three of the sections comprising rigid grids that lie in respective planes. The sections can be coplanar when the deck is in a flat position. Several cross members can be provided to support the deck sections. Holders, which can be comprised of slots that are formed in the cross members, provide bidirectional support to side rails. In this regard, the bed rails can be removably positioned within the slots to maintain the position of the bed rails and eliminate rail migration.

8 Claims, 9 Drawing Sheets

BED WITH GRID DECK

This application is a continuation-in-part of U.S. Design application having Ser. No. 29/331,033 filed on Jan. 17, 2009 now U.S. Pat. No. Des. 616,666, the contents of which are hereby incorporated herein by reference.

BACKGROUND OF THE INVENTION

1. Field of the Invention

The present invention relates to a bed having a rigid deck having holders for bidirectionally maintaining a position of one or more bed rails.

2. Description of the Related Art

Beds with wire grid decks have been known for years. Typically, the wire grids are supported by perimeter frames. Bed rails can be positioned between segments of the wire grids.

One drawback of this existing bed type is that the wire frame is not directly supported under the user.

Another drawback of this existing bed type is that there are no mechanisms for preventing migration of the bed rails. The bed rails are longitudinally supported in only a single direction by segments of the wire grid. While this practice may be acceptable for some, it definitely can be improved upon.

A further drawback of this existing bed type is a lack of structural rigidity.

Thus there exists a need for a bed with a grid deck that solves these and other problems.

SUMMARY OF THE INVENTION

The present invention relates to a bed having a rigid deck supported over the base. Four sections can be provided, with three of the sections comprising rigid grids that lie in respective planes. The sections can be coplanar when the deck is in a flat position. Several cross members can be provided to support the deck sections. Holders, which can be comprised of slots that are formed in the cross members, provide bidirectional support to side rails. In this regard, the bed rails can be removably positioned within the slots to maintain the position of the bed rails and eliminate rail migration.

According to one advantage of the present invention, the deck is comprised of rigid grids. This structural rigidity improved performance and durability of the bed.

According to another advantage of the present invention, the cross members support the grid sections. In a preferred embodiment, the cross members comprise angle members, which provide a high degree of longitudinal support.

According to yet a further advantage of a preferred embodiment of the present invention, the cross members can comprise slots at their ends. Bed rails can have tabs that are supported by the slots. The slots provide longitudinal support to the bed rails, and therefore prevent migration of the bed rails.

According to an alternative embodiment of the present invention, holders or slots may be formed around the perimeter of the bed in the absence of cross members.

Other advantages, benefits, and features of the present invention will become apparent to those skilled in the art upon reading the detailed description of the invention and studying the drawings.

DETAILED DESCRIPTION OF THE PREFERRED EMBODIMENTS

Figure 1:
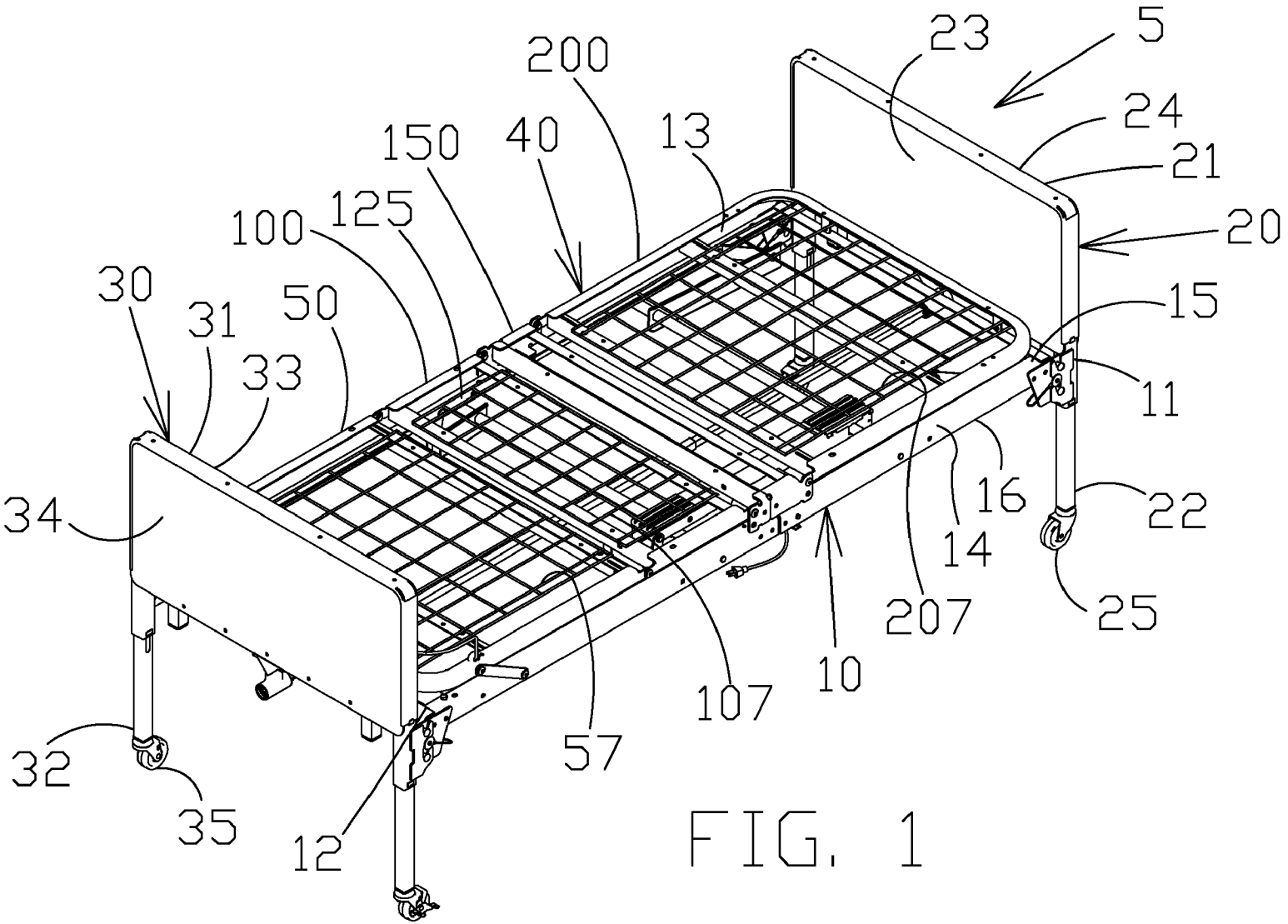
FIG. 1 is a perspective view of a preferred embodiment of the present invention shown in a flat position.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

A preferred embodiment of the present invention is illustrated in FIGS. 1-10. Looking now to FIGS. 1-4, it is seen that a bed 5 is illustrated. The bed 5 has a base 10 with a head piece 20 and a foot piece 30. A deck 40 is also shown. The deck 40 has sections 50, 100, 150 and 200. Each of these are described in detail below. These components may be made of a variety of materials, such as steel or aluminum or any other suitable material.

The base 10 has a first end 11 and a second end 12. A first side 13 and an opposed second side 14 are also provided. Further, the base 10 has a top 15 and a bottom 16. The head piece 20 and the foot piece 30 are supported by the base. The deck 40 is also supported by the base 10. The base 10 can be comprised of two individual members that are fastened, fixed or otherwise connected together. The base can generally lie in and define a plane.

The head piece 20 has a top 21 and a bottom 22. Sides 23 and 24 are also provided. Castors 25 are shown at the bottom 22 of the head piece. The head piece may be altered, integrated into the base or even deleted without departing from the broad aspects of the present invention.

The foot piece 30 has a top 31 and a bottom 32. Sides 33 and 34 are also provided. Castors 35 are shown at the bottom 32 of the foot piece. The foot piece may be altered, integrated into the base or even deleted without departing from the broad aspects of the present invention.

In the preferred embodiment, the head piece is preferably generally parallel to the foot piece, and each of the foot piece and the head piece preferably lie in planes that are generally perpendicular to the base plane.

Looking now to FIGS. 5-10, it is seen that a preferred embodiment of a deck 40 is provided.

A first section 50 has ends 51 and 52, sides 53 and 54, a top 55 and a bottom 56. A gird 57 is provided. The grid 57 is preferably generally rigid, and lies in a plane 58. Cross beams 60 and 70 are provided. Cross beam 60 has and end 63 with a slot 64 therein, and an opposite end 65 with a slot 66 therein. Cross beam 70 has an end 73 with a slot 74 therein, and an opposed end 75 with a slot 76 therein. Cross beams 60 and 70 are preferably generally parallel to each other, and preferably span completely between sides 53 and 54 of the section 50. Each cross beam is preferably constructed of an angle member comprising a generally vertical section and a generally horizontal section. The horizontal section has a surface that directly supports the grid 57. The vertical section provides structural support, and preferably depends from, or is located below, the horizontal section.

A connector 80 is provided for movably connecting the first section 50 to the base 10. The connector can comprise an arm that is pivotally connected to both the first section 50 and the base 10. The section is movable between being flat and inclined.

While slots are illustrated, it is understood that other holders such as holes, clamps, pins may be utilized in place of slots without departing from the broad aspects of the present invention.

Further, while the slots are shown in a preferred embodiment adjacent the ends of respective cross beams, it is understood that the location of the slots could be located on any structure that is at or near the side perimeter of the section, and even integrated into the side perimeter, without departing from the broad aspects of the present invention. It is preferred that the slots be at or adjacent to the top 55 of the section 50.

A second section 100 has ends 101 and 102, sides 103 and 104, a top 105 and a bottom 106. A grid 107 is provided. The grid 107 is preferably generally rigid, and lies in a plane 108. Cross beams 110 and 120 are provided. Cross beams 110 and 120 have opposed ends that extend to the sides 103 and 104, respectively of the section 100. Cross beams 110 and 120 are preferably generally parallel to each other. Each cross beam is preferably constructed of an angle member comprising a generally vertical section and a generally horizontal section. The horizontal section has a surface that directly supports the grid 107. The vertical section provides structural support.

A connector 130 is provided for movably connecting the second section 100 to the base 10. The connector 130 can comprise a first arm 131 having a first end 132 and a second end 133, and a second arm 134 with a first end 135 and a second end 136. The arms 131 and 134 are pivotally connected to each other, and the ends of opposed arms, respectively, are pivotally connected to the base 10 and to a cross tab 125. In the preferred embodiment, there are two cross tabs 125, each parallel to each other and spanning between the first cross beam 110 and the second cross beam 120. The cross tabs 125 provide a structure for the connector 130 to attach to wherein the second section 100 is prevented from going over center during the elevating and/or flattening of the second section 100.

A third section 150 is further provided. The third section 150 has a first end and a second end. A first cross beam 160, a second cross beam 170 and a cross member 180 are provided. The first and second cross beams 160 and 170 each have a vertical section and a horizontal section. The horizontal sections are coplanar, and the vertical sections are preferably generally parallel to each other. The cross member 180 is preferably located below the cross beams 160 and 170. The third section 150 is preferably a stationary section.

A fourth section 200 has ends 201 and 202, sides 203 and 204, a top 205 and a bottom 206. A grid 207 is provided. The grid 207 is preferably generally rigid, and lies in a plane 208. Cross beams 210 and 220 are provided. Cross beam 210 has and end 213 with a slot 214 therein, and an opposite end 215 with a slot 216 therein. Cross beam 220 has an end 223 with a slot 224 therein, and an opposed end 225 with a slot 226 therein. Cross beams 210 and 220 are preferably generally parallel to each other, and preferably span completely between sides 203 and 204 of the section 200. Each cross beam is preferably constructed of an angle member comprising a generally vertical section and a generally horizontal section. The horizontal section has a surface that directly supports the grid 207. The vertical section provides structural support.

A connector 240 is provided for movably connecting the fourth section 200 to the base 10. The connector 240 can comprise a first arm 241 having a first end 242 and a second end 243, and a second arm 244 with a first end 245 and a second end 246. The arms 241 and 244 are pivotally connected to each other, and the ends of opposed arms, respectively, are pivotally connected to the base 10 and to the fourth section 200. The section is movable between being flat and inclined.

Figure 2:
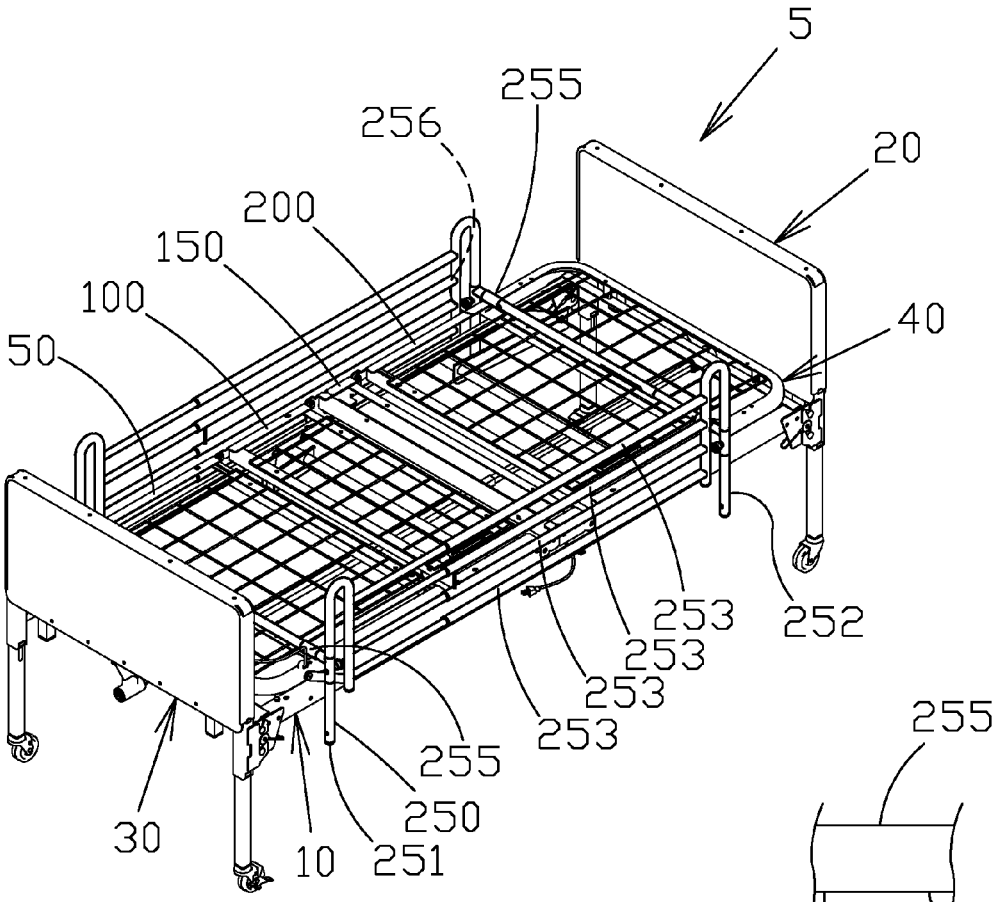
FIG. 2 is a perspective view of the preferred embodiment of FIG. 1 shown with bed rails attached.
Figure 2A:
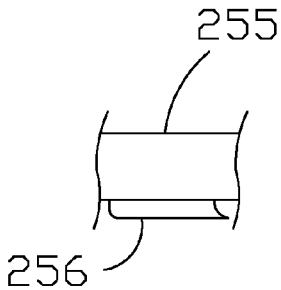

Side rails 250, or simply rails, can be provided. The rails 250 have a first end 251 and a second end 252. A plurality of telescoping members 253 are provided. The sides of a pair of rails are connected with a cross member 255. The cross member 255 has opposed ends. A tab 256, plunger or other structure is preferably at or near each end of the cross member 255. One example of a tab is illustrated in FIG. 2A. Yet, it is understood that alternative structures may be utilized without departing from the broad aspects of the present invention. The tabs 256 can be removably inserted into the slots on the deck 40. In the embodiment illustrated in FIGS. 2 and 4, the rail is a full rail that is removably held by slots in the first and fourth sections. The slots prevent bidirectional longitudinal movement of the rails. Hence, unwanted rail migration is eliminated.

Figure 3:
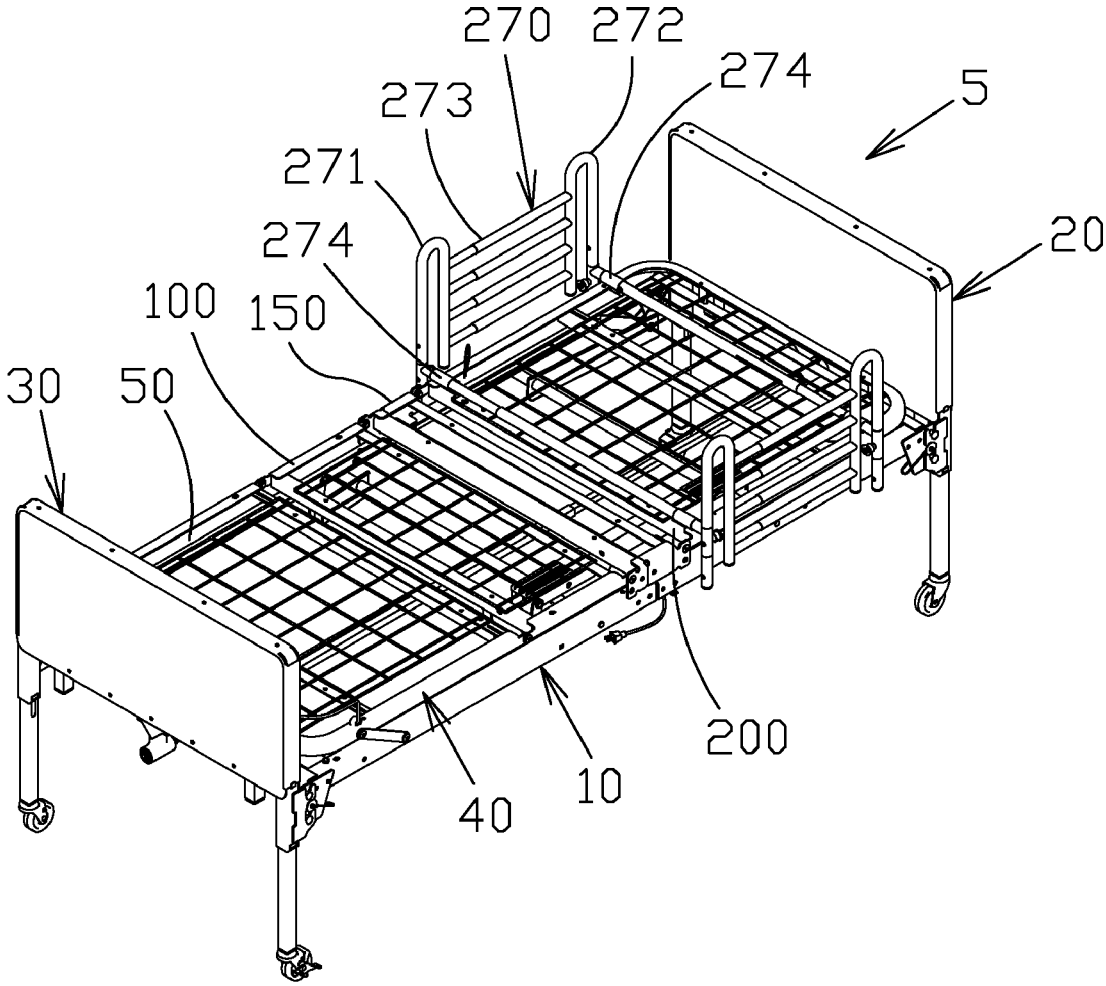
FIG. 3 is a perspective view of the preferred embodiment of FIG. 1 shown with alternative bed rails attached.
Figure 4:
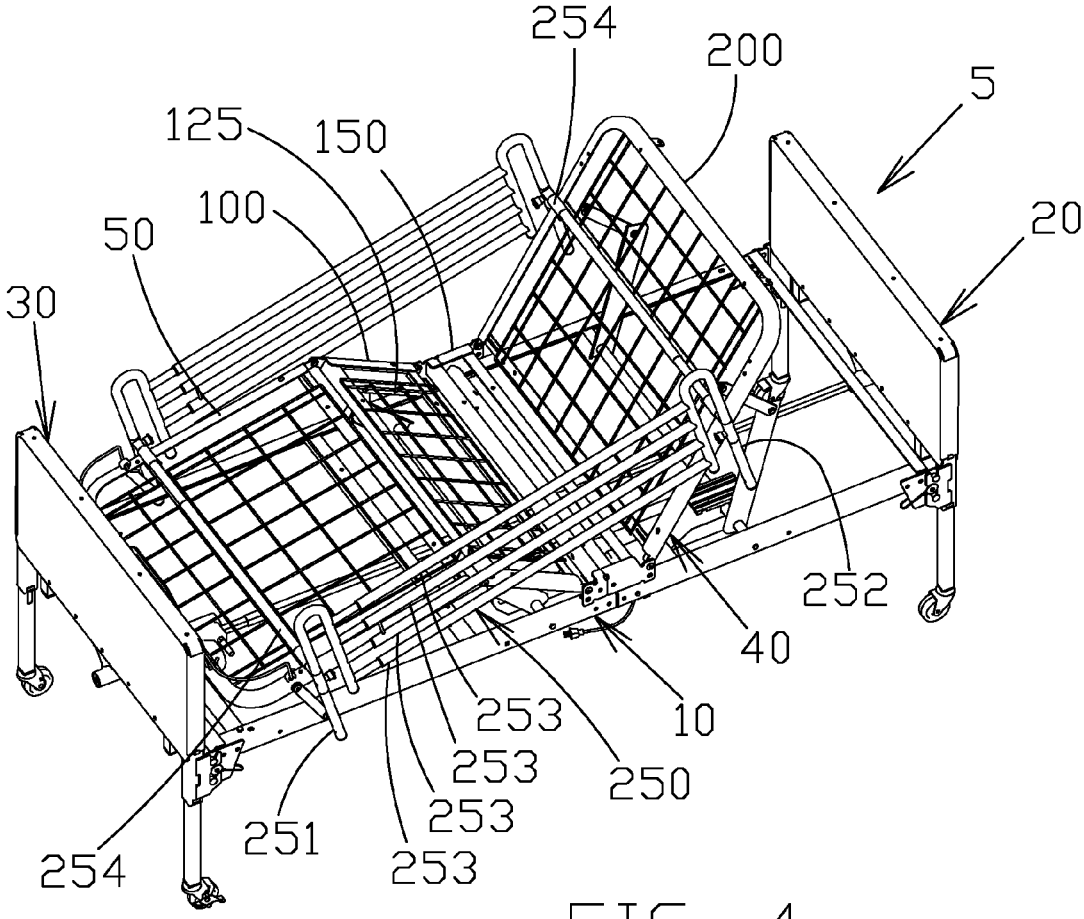
FIG. 4 is a perspective view of the preferred embodiment shown in FIG. 2, shown in an inclined position.
Figure 5:
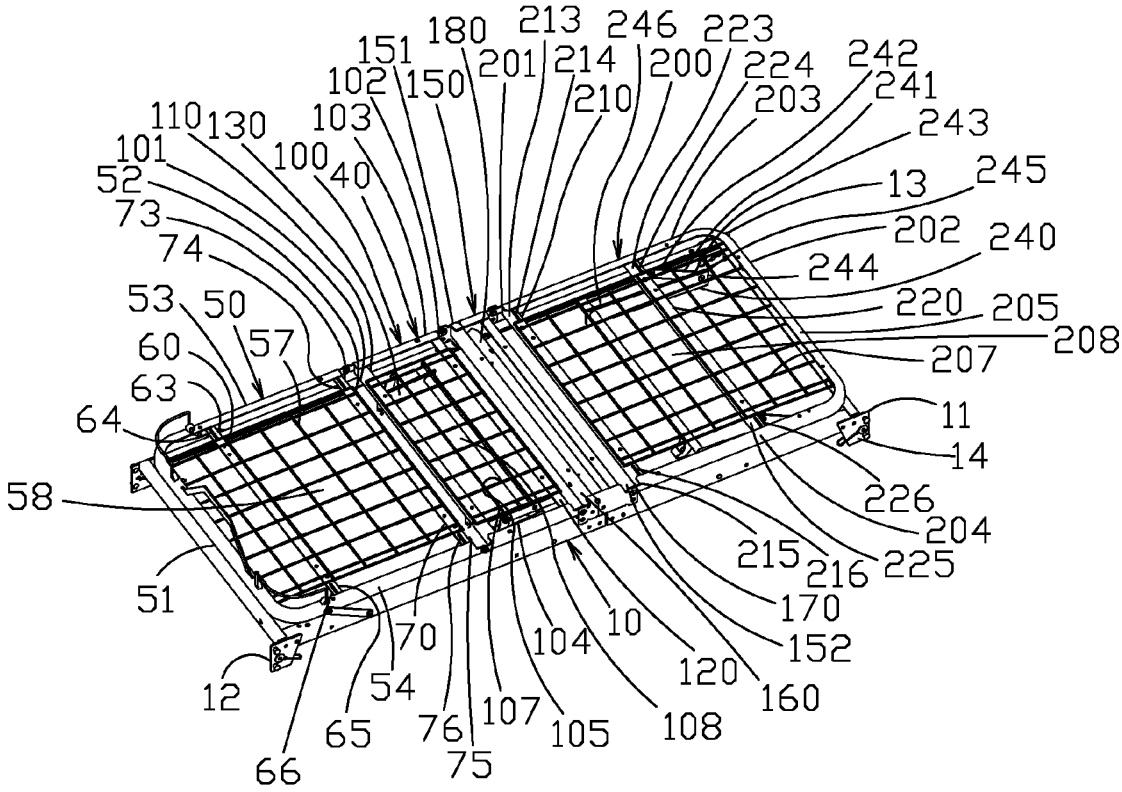
FIG. 5 is a perspective view of a preferred deck of the present invention.
Figure 6:
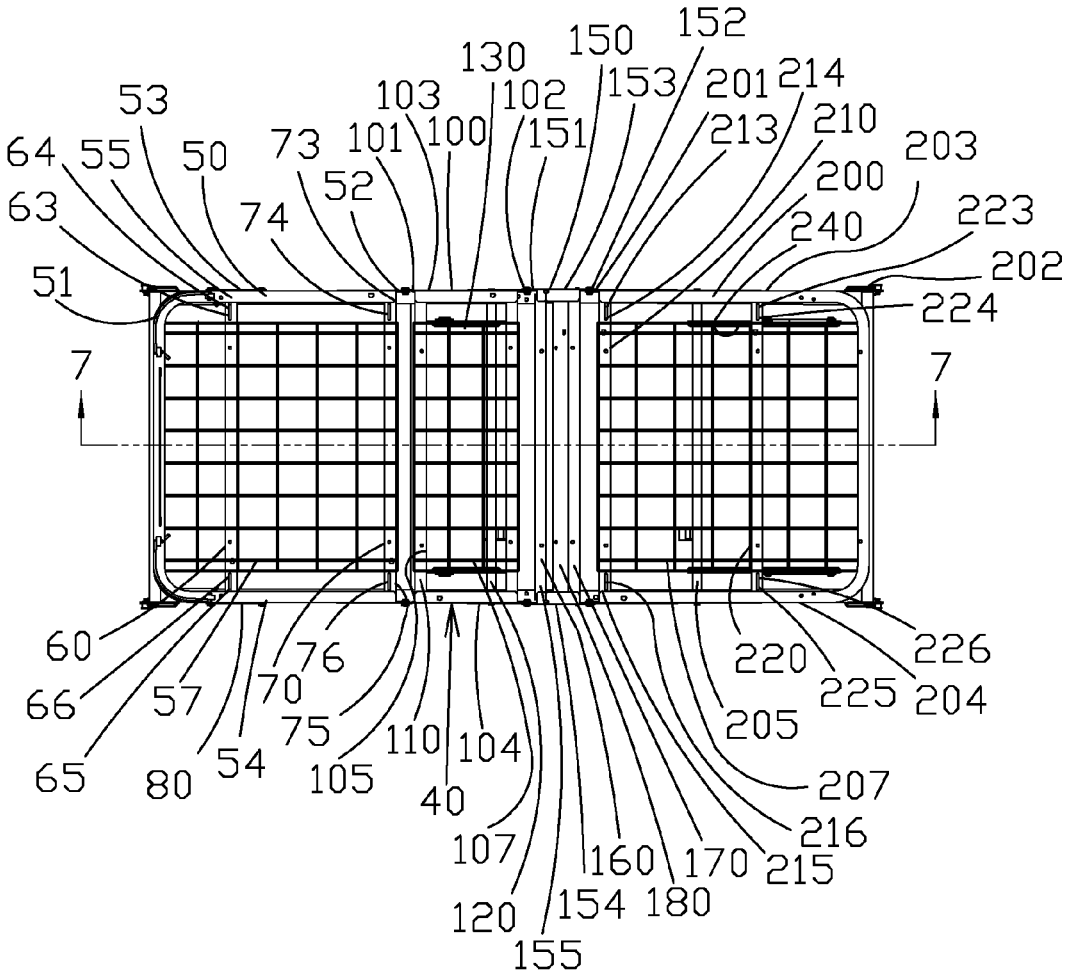
FIG. 6 is a top view of the preferred deck of the present invention as shown in FIG. 5.
Figure 7:
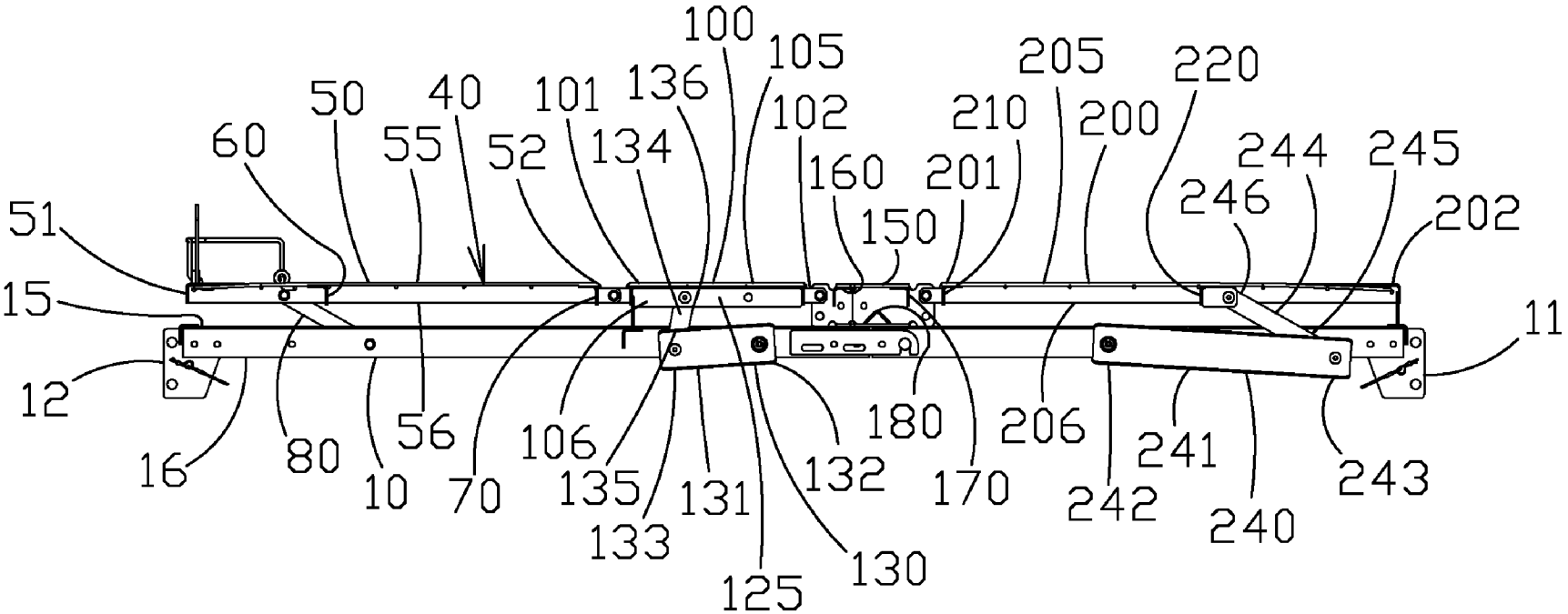
FIG. 7 is a cross-sectional view of the preferred deck of the present invention taken along line 7-7 in FIG. 6.
Figure 8:
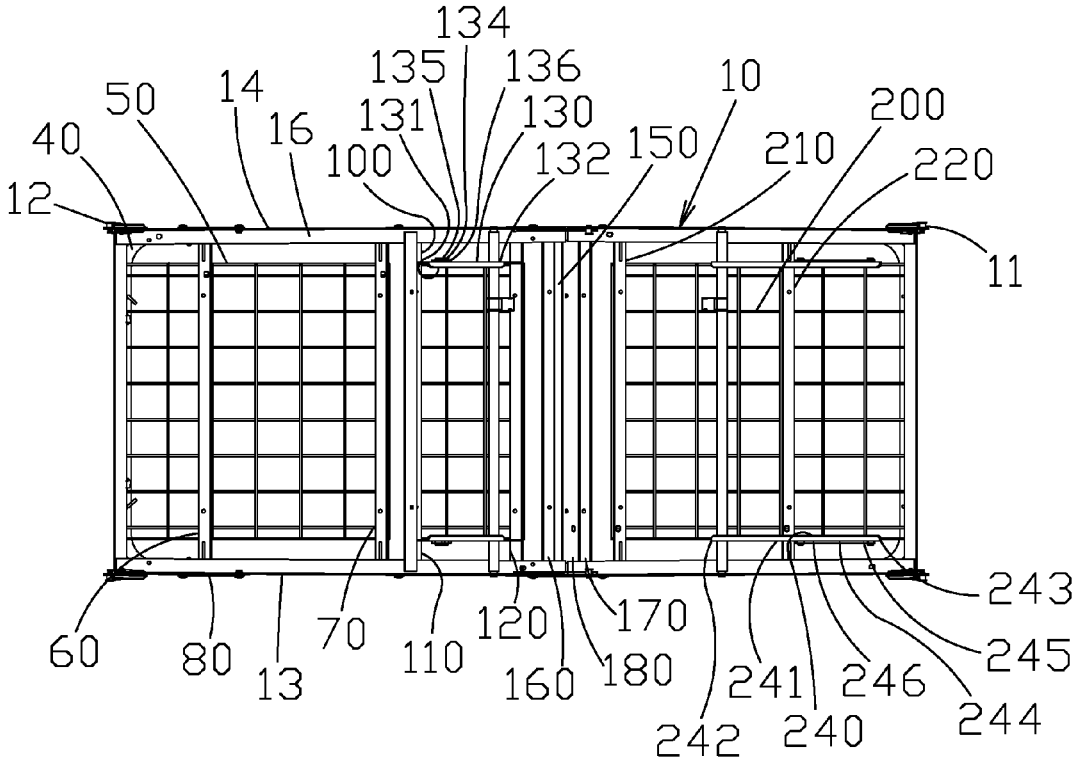
FIG. 8 is a bottom view of the preferred deck of the present invention as shown in FIG. 5.
Figure 9:
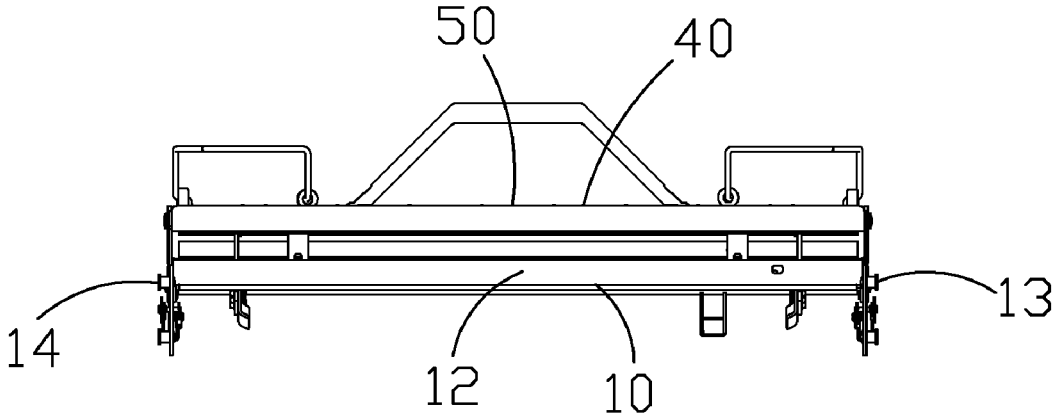
FIG. 9 is an end view of the preferred deck of the present invention as shown in FIG. 5.
Figure 10:
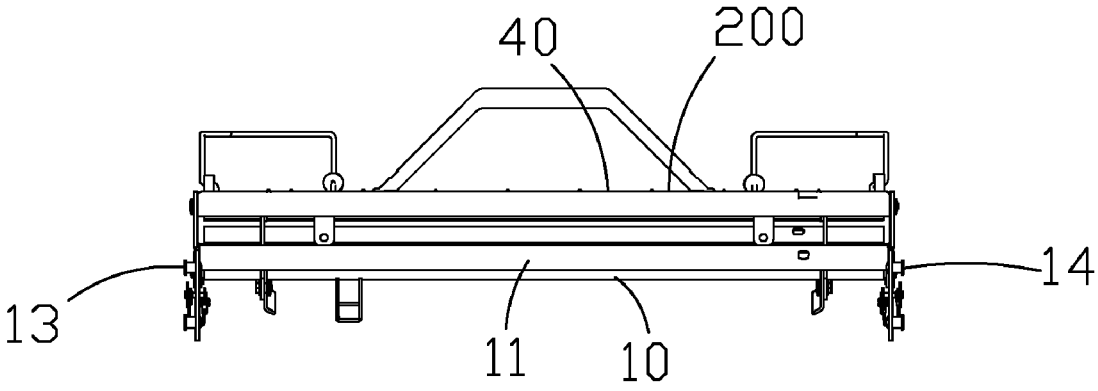
FIG. 10 is an opposite end view of the preferred deck of the present invention as shown in FIG. 5.

In the embodiment illustrated in FIG. 3, an alternative rail 270 is provided. The rail 270 is a partial length rail having ends 271 and 272, telescopic member 273 and cross members 274. Tabs are provided for holding the rail in the intended location along the sides of the bed.

It is understood that the second section is pivotally connected to the first section and to the third section. The fourth section is pivotally connected to the third section. The second end of the first section and the first end of the second section rise to an inclined position and lower to a flat position the same amount during the operation of the bed.

Thus it is apparent that there has been provided, in accordance with the invention, a bed with a grid deck that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A deck for a bed, wherein said deck comprises:

a first end and a second end, a deck top and a deck bottom;

a longitudinal axis;

a perimeter, a plurality of cross beams extending between and being stationarily connected to said perimeter; and a plurality of holders formed directly into said plurality of cross beams, said plurality of holders each being located interior of said perimeter wherein each of said plurality of holders comprises a slot that is vertically oriented and is located adjacent said deck top, wherein a telescopic side rail is directly and removably insertable into said slot of two of said plurality of holders and is bidirectionally supported by said two of said plurality of holders.

2. The deck of claim 1 wherein said deck comprises at least one grid.

3. The deck of claim 2 wherein each of said plurality of cross beams comprises:

a vertical section; and a horizontal section, wherein said vertical section depends from said horizontal section.

4. The deck of claim 3 wherein:

each of said plurality of said holders is located through said horizontal section of a respective cross beam.

5. The deck of claim 4 wherein each of said plurality of holders comprises a slot that is located at an end of a respective cross beam.

6. The deck of claim 3 wherein:

said at least one grid comprises at least one rigid grid; and said at least one rigid grid is directly supported by one of said plurality of cross beams.

7. The deck of claim 1 further comprising:

a first section having a first section grid;

a second section having a second section grid;

a third section; and a fourth section having a fourth section grid, wherein:

said first section grid, said second section grid and said fourth section grid are each movable between a first flat position, and a second inclined position, and said telescopic side rail is bidirectionally supported throughout the movement of said first section grid, said second section grid and said fourth section grid.

8. The deck of claim 7 wherein said second section comprises at least one cross tab.

* * * * *